US008333309B2

(12) United States Patent
Riddleberger

(10) Patent No.: US 8,333,309 B2
(45) Date of Patent: Dec. 18, 2012

(54) HUNTER'S ADJUSTABLE ENCAPSULATING SCENT ADSORPTION SYSTEM WITH COMBINATION PACK AND DETACHABLY SECURABLE FLEXIBLE FUNNEL FOR HUMAN ODOR ADSORPTION

(75) Inventor: Kenneth Todd Riddleberger, Chesapeake, VA (US)

(73) Assignee: Kenneth Riddleberger

( * ) Notice: Subject to any disclaimer, the term of this patent is extended or adjusted under 35 U.S.C. 154(b) by 457 days.

(21) Appl. No.: 12/660,633

(22) Filed: Mar. 2, 2010

(65) Prior Publication Data

US 2011/0215124 A1 Sep. 8, 2011

(51) Int. Cl.
*A45F 4/02* (2006.01)

(52) U.S. Cl. ..... 224/153; 224/577; 224/154; 422/120

(58) Field of Classification Search ..... 422/120; 224/645, 577, 153, 154
See application file for complete search history.

(56) References Cited

U.S. PATENT DOCUMENTS 7,374,071 B2 * 5/2008 Lavelle ..... 224/153

* cited by examiner

*Primary Examiner* — Sean E Conley

(57) ABSTRACT

A system of odor control comprising a combination pack which functions as a chamber for human odor adsorption wherein a connected or detachably securable flexible funnel may be stowed, stored, deployed and/or used independently further comprising a detachably securable odor adsorption means, a detachably securable odor filtering means, a pocket, a fastening means and a vent located about one or more portions of said pack and/or said flexible funnel wherein said product may be located about the user and/or used to surround a portion or substantially all of a user while hunting to reduce odor that would normally alert game. One or more vents may be adjustable and used to regulate airflow and/or allow the user to enter, exit, or expose a portion of the user or the user in entirety and/or an item from the flexible funnel at a desirable moment of activity.

20 Claims, 2 Drawing Sheets

HUNTER'S ADJUSTABLE ENCAPSULATING SCENT ADSORPTION SYSTEM WITH COMBINATION PACK AND DETACHABLY SECURABLE FLEXIBLE FUNNEL FOR HUMAN ODOR ADSORPTION

BACKGROUND OF THE INVENTION

1. Field of the Invention

The invention relates to a system of odor adsorption to be used by a hunter to avoid alerting game.

2. The Prior Art

Tree stands are devices used by hunters, photographers and other persons to situate themselves in an elevated position in order to gain a better vantage point than what is available from the ground. In certain environments hunters will hunt from a tree stand that is secured to a tree of appropriate size. Tree stands include climbing stands, portable stands, and permanent stands. Climbing stands are removed from the tree to which they are secured after each use. Portable stands may be removed after a single hunt but typically stay for a season. Permanent stands may remain secured to a tree for multiple seasons. Portable or permanent tree stands may include a ladder for the user to climb up to and down from the stand.

Hunting from a tree stand alone, is not a sufficient technique to prevent most big game animals from detecting hunters through the sense of smell especially where varying topography and changing wind currents exist. In certain environments the user may stand or sit in front of a tree when hunting on the ground. Typically, hunters will hunt from several different stand types and several locations during a season. Many archers, gun hunters and muzzleloader hunters prefer to use a climbing stand due to the user's ability to more easily reposition themselves when addressing changes in wildlife patterns.

Hunters may also position themselves in areas that are open or where trees or other attachable objects may not be readily available or desirable. Users may also elect to pursue a species of quarry on foot, commonly referred to as stalking, wherein the present system will provide effective odor control while moving about in pursuit of wildlife.

It is also known to use a pack to carry gear, provisions, etc. to a location where a user will engage in an outdoor activity such as hunting. There is an extreme need for an effective, portable, replaceable and containable odor control system offering users the benefits of easy set up and storage in varying stand locations. Animals will change patterns for numerous reasons such as location of food sources, predation, weather, mating habits or other and hunters may need to reposition in order to keep up with the changing patterns of wildlife.

Previous art has failed to incorporate a system of replaceable odor control wherein the carrying means may function as a chamber for improved human odor-adsorption and further consist of and provides storage of a detachably securable flexible funnel when not in use. Furthermore, previous art does not address the need or incorporate a system of odor control that adsorbs and funnels human and unnatural odor into an adsorption means or into an odor filtering means located about said flexible funnel or said pack containing additional odor adsorption means or odor filtering means. Further, said product provides a system of odor control that prevents normal devastating wind currents from dissipating scent freely downwind when hunting. Vents or airflow features located about the flexible funnel may also allow wind currents to assist or force a user's odor into contact with an adsorption means located about the user. Additionally, the system allows the user to implement substantial amounts of replaceable odor adsorption means and odor filtering means thereby providing effective scent control for the user. Further, the system preserves the replaceable said odor adsorption means and said odor-filtering means from contamination when not being used, during storage or other.

BRIEF SUMMARY OF THE INVENTION

The invention relates to a system of odor control comprising a combination pack having an odor adsorption means or odor filtering means and a detachably securable flexible funnel having an odor adsorption means or odor filtering means wherein said means is detachable securable to said portions and designed for use while hunting from the ground, a blind, tree stand or other. The pack contains an easily deployable flexible funnel having one or more straps on the rear or other portion of the pack which may be used to detachably secure the pack to an object or other and a pair of shoulder carrying straps secured to the rear portion of the pack. A pack including a flexible funnel adapted to be stowed within the pack when the flexible funnel is not deployed. The combination pack and flexible funnel may be deployed and used or attached to a selected object such as a tree or other, wherein the user may then unzip or by other means open a compartment of the pack and deploy the flexible funnel for use. The flexible funnel may be disconnected from the pack and used. The flexible funnel contains preferably pre-installed and replaceable odor adsorption means or odor filtering means and may be draped, wrapped or suspended about a portion or the entire user. Portions or all of the pack and flexible funnel may be constructed of materials that aid in preventing the escape of odor from areas that may not contain an odor adsorption means or that help to preserve the integrity of the odor adsorption or odor filtering means. The flexible funnel may be made of breathable or non-breathable materials depending on a user's preference when encountering warmer climates or for use during inclement weather or other. Said product may be used while hunting or in route to or from a hunting location, it may be deployed and used at a hunting location, or it may be securable stowed in the said pack preventing contamination for a return hunt.

A benefit of the said product is that an odor adsorption means may be exteriorly positioned about the user, such as the downwind side of the user so as to allow the flexible funnel to absorb odor and prevent wind currents from freely carrying odor toward game.

A further benefit of the said product is that it is suitable for use while hunting from the ground.

Another benefit of the said product is that it can be quickly and easily implemented when hunting from a tree stand.

Another benefit of the said product is that a user may replace the odor adsorption means and odor filtering means enabling optimal performance.

A further benefit of said product is that normally secreted body odor; clothing containing unnatural odor or other odor-emitting items may be substantially surrounded or enclosed in the flexible funnel allowing the user to benefit from the unique function of said product.

An additional benefit is that the user may substitute portions that may contain a different camouflage pattern or portions that may contain a different weather barrier property without having to buy an entire new system.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

Figure 1:
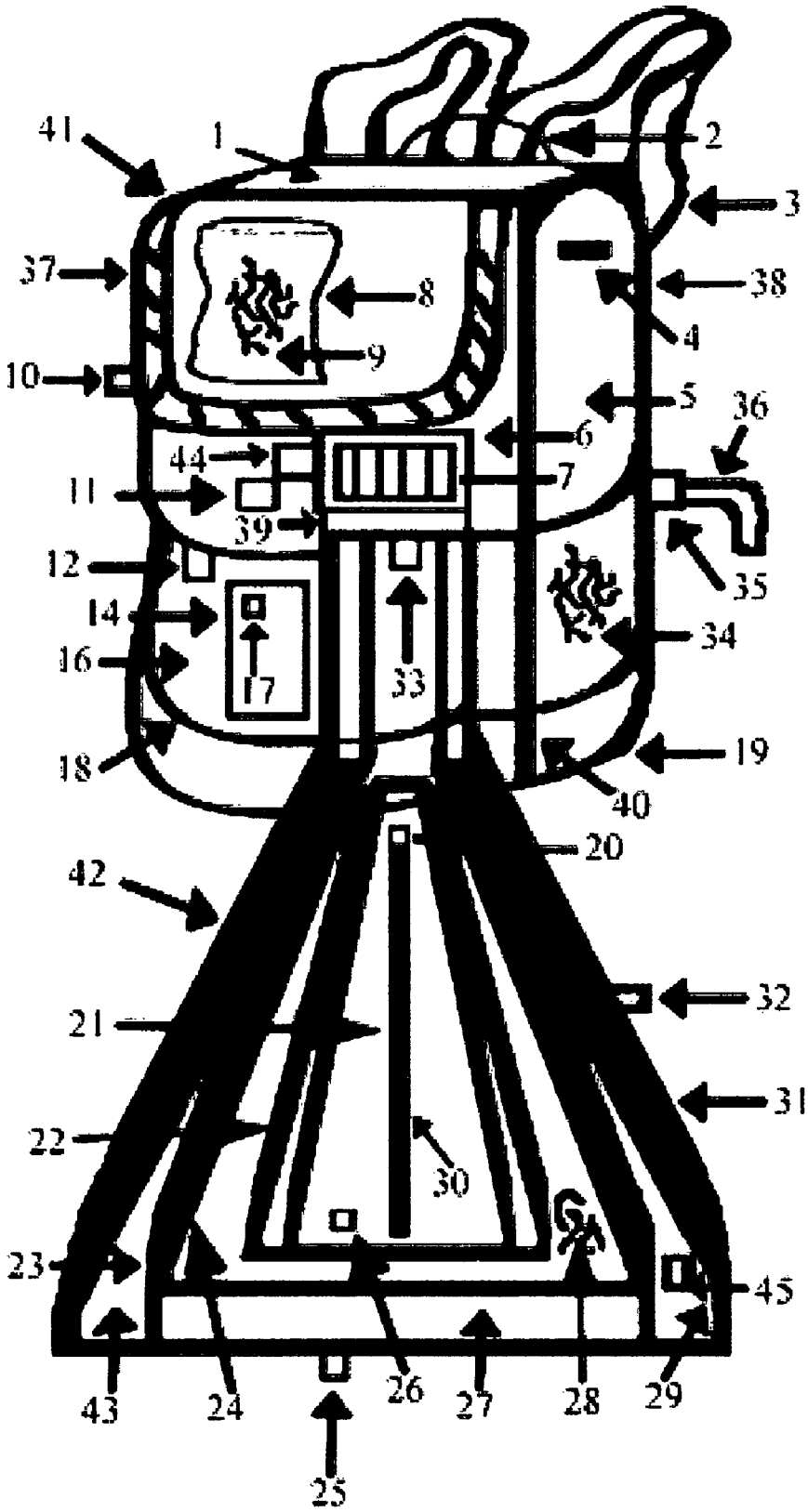
FIG. 1 shows a front perspective view of pack 41 and flexible funnel 42 wherein pack 41 and flexible funnel 42 may be positioned about the user and may be detachably secured to a tree or other object, a rear portion 40 contains a fastener for securing said product to an object if desired and main compartment 5 is in an open position and flexible funnel 42 is in a deployed position.

As shown in FIG. 1, pack 41 has a pair of shoulder carrying straps 3 for transporting the unit to and from a location where it is to be used. Shoulder carrying straps 3 are located on rear portion 40 of pack 41 and may be adjustable to accommodate users of various sizes. Rear portion 40 of pack 41 may be detachably secured to flexible funnel 42, for example with a zipper 33 or other suitable fastener.

A top portion 1 of pack 41 as shown in FIG. 1 is in an open position and flexible funnel 42 as shown in FIG. 1 is in a deployed position extending from pack 41. Flexible funnel 42 may extend vertically, horizontally, diagonally, or irregularly for a portion, substantially all or the entire user and include regions above and below the user and be deployed from main compartment 5 or secondary compartment 16 or from first surface 19 or secondary surface 18 and may be detachably securable about internal or external portions. Flexible funnel 42 may be detachably securable to pack 41 such that flexible funnel 42 may be removed from the unit when it is not needed, or for repair, replacement, or exchange with a flexible funnel having a different coloration or pattern, weather properties, or other. Flexible funnel 42 may be detachably secured to pack 41 with fastener 33 such as a zipper, buckles, d-rings, snaps, hook and loop fasteners, buttons, magnets, VELCRO® or ties.

Pack 41 and flexible funnel 42 may be used while hunting on the ground or while hunting with a climbing, portable or fixed tree stand or other. As shown in FIG. 1, in a deployed position flexible funnel 42 may be draped, wrapped or suspended about portions, substantially all, or so as to enclose the majority of the user. When deployed flexible funnel 42 provides effective odor adsorption means and may be detachably securable about the user, a tree or other via straps 3, strap 36, fasteners 35 or loop 2.

One or more pockets 12 may be internally or externally located about pack 41 and may be of various shapes and sizes and configured to store various equipment or provisions which a user of pack 41 and flexible funnel 42 may require, for example, binoculars, game calls, ammunition water bottles, food, communication devices, range finders, etc.

Preferably, one or more pockets 12 may be located on an internal surface of pack 41 or flexible funnel 42, which faces a user and may be easily accessible allowing a user to retrieve and return gear to pockets 12 and remain substantially surrounded by flexible funnel 42 wherein game or other wildlife is less likely to detect the user. Additionally, access to compartments of pack 41 may be provided via top surface 1 so that main compartment 5 or secondary compartment 16 may also be easily and quietly accessed by a user. Main compartment 5 may be accessed, for example, via a zipper 10 provided about top surface 1 or side surface 37 or other of pack 41.

Flexible funnel 42 may be made from a thin, flexible material, which may be easily wrapped or folded for storage inside pack 41. Pack 41, is preferably constructed of water repellant, weatherproof or non-breathable materials. Flexible funnel 42 may be constructed of water repellant, weather proof, breathable or non-breathable materials or their combination as desired for use in varying climates, weather or other. Flexible funnel 42 may be constructed of a material, which does not produce excessive noise when deployed, stowed, impacted or otherwise used.

Pack 41 may contain a vent 4 and flexible funnel 42 may contain a plurality of vents 30, 43, 27 and may be secured or adjusted independently by fastener 25, 32, 45 which may also be secured about one or more edges so as to enclose a portion or portions of the user. Pack 41 and flexible funnel 42 preferably include a pattern and coloration on exposed surfaces 31, 18, 19, 40, 1, 37, 3 or other internal or external portions which blend into the environment where said product is to be used. For example pack 41 may include a camouflage pattern 34 and flexible funnel 42 may include a camouflage pattern 28, which blends into the environment while hunting from a tree stand or while hunting on the ground. Additionally, at least a portion of pack 41 and/or flexible funnel 42 may be a solid color or a highly visible color known as blaze orange.

Flexible funnel 42 has one or more loop fasteners 33 for detachably securing flexible funnel 42. Loop fastener 33 provides a means for detachably securing flexible funnel 42 to pack 41, and may further be selected from zippers, buckles, d-rings, snaps, hook and loop fasteners, buttons, magnets, VELCRO®, or ties. Pack 41 may also be used to store items such as replaceable odor adsorption means 14 or 21 and may include a fastener 17 or 26 and may be stowed in either main compartment 5 or secondary compartment 16. A removable portion 8, which may contain an odor adsorption means 14 and an odor filtering means 7 and a pocket 12, and may be detachably securable about flexible funnel 42 about one or more sides or portions by fastener 17 or 26 or other suitable fastener and wherein said removable portion 8 may contain a pattern and coloration 9 and wherein said flexible funnel 42 and said removable portion 8 may be stowed in said pack 41.

Figure 2:
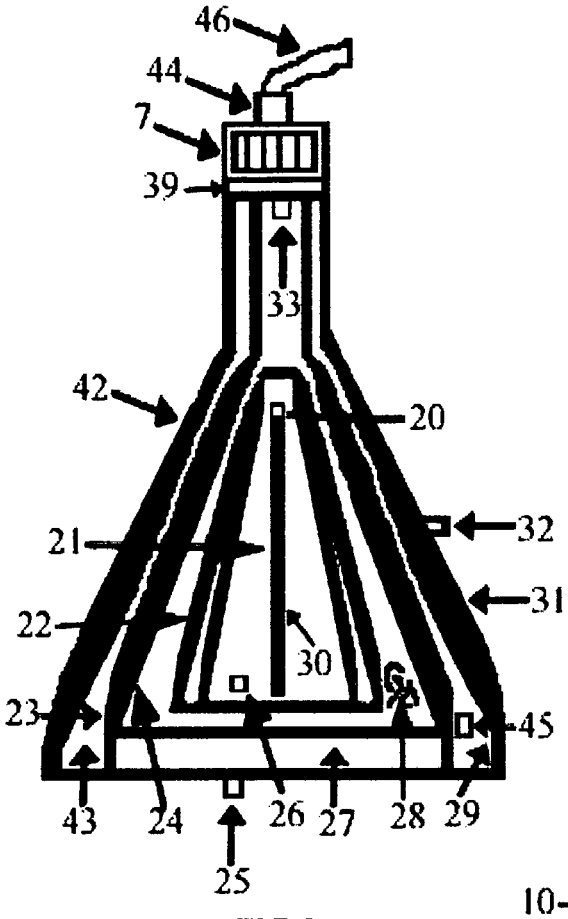
FIG. 2 shows a front perspective view of flexible funnel 42, or a portion of FIG. 1 in a deployed position where the user may elect to use it alone for the purposes herein.

FIG. 2 shows flexible funnel 42 in a deployed or disconnected position containing a breathable or non-breathable pocket 22 detachably secured wherein an odor adsorption means 21 is attached by a fastener 26 located about said flexible funnel 42. Further, a vent 30 is viewable on flexible funnel 42 wherein fastener 20 may consist of a zipper or other and be used to open, close or access the interior or exterior of flexible funnel 42 by the user. Flexible funnel 42 may consist of one or more layers and contain a vent 43 located about the edge or edges and wherein said edges may be secured or adjustably secured by fastener 45. Materials of similar or dissimilar properties may be used to construct said flexible funnel wherein features and composition may be more desirable when encountering warmer or changing weather. FIG. 2 shows flexible funnel 41, in an optional multiple layer design viewable as 23, 24, 29 and 31.

Additionally, two or more sides or portions may be joined together by a fastener such as along the edge of layer 23 and the edge of layer 31 by a fastener 32 or may be used to adjoin portions of a single layer 31 and may consist of a zipper, snap or other suitable fastener and wherein said fastener 32 may also allow access to said vent 43 or said vent 30 or other which may allow the user to use said vent as a portal to enter, exit, or expose a portion or all of the entire user from flexible funnel 42. Flexible funnel 42 may contain a pattern and coloration 28. Further, flexible funnel 42 may contain a vent 39 or opening located adjacent a detachably securable odor filtering means 7 and cover 6 and preferably be located in the uppermost portion of flexible funnel 42 and may be secured by a fastener 33. Odor filtering means 7 may be secured about an upper portion of flexible funnel 42 via a fastener 44 and wherein flexible funnel 42 may contain a strap 46, which allows it to be adjustably positioned about pack 41 or other items.

Figure 3:
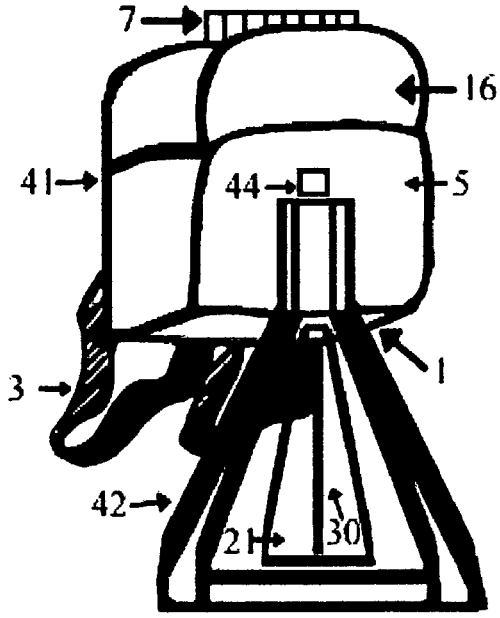
FIG. 3 shows an alternate view of the pack 41 and flexible funnel 42 of FIG. 1 wherein said product may be used while hunting on the ground or in a climbing, portable or fixed tree stand, with the pack in an opened position and the flexible funnel is in a deployed position.

FIG. 3 shows an alternate view of pack 41 in a position detachably secured to flexible funnel 42. Flexible funnel 42 may be secured via fastener 44 and extend from main compartment 5 through top layer 1 (viewed on the bottom while inverted) and straps 3 which may be used to carry pack 41 being located about an exterior surface. Further, said odor filtering means 7 is located exteriorly of secondary compartment 16 of pack 41. Flexible funnel 42 is in a deployed position showing vent 30 and a detachably securable odor-adsorption means 21 located about flexible funnel 42.

Figure 4:
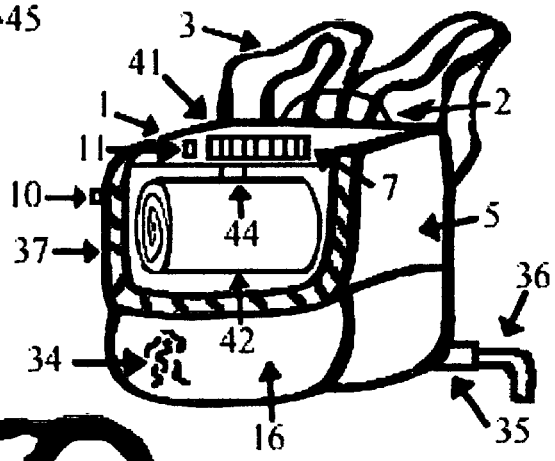
FIG. 4 shows a front perspective view of pack 41 and flexible funnel 42 according to one embodiment of the invention wherein a top portion 1 is in a closed position and flexible funnel 42 is in a stowed position located within main compartment 5 of said pack 41.

FIG. 4 shows pack 41 and flexible funnel 42 wherein main compartment 5 and secondary compartment 16 are in a closed position and flexible funnel 42 in a stowed position within main compartment 5 secured by fastener 10. An odor filtering means 7 may be attached by fastener 11 and enclosed within main compartment 5 or secondary compartment 16 or other. One or more straps 3 are disposed at a top portion of pack 41. Strap 3 and 36 may be configured to wrap around a portion of a tree or other object allowing pack 41 to detachably hang from the tree during use and storage. Strap 36 may be provided with any conventional detachable fastener 35, for example buckles, d-rings, snaps, hook and loop fasteners, buttons or ties and be located about said surface 37 or other location.

Figure 5:
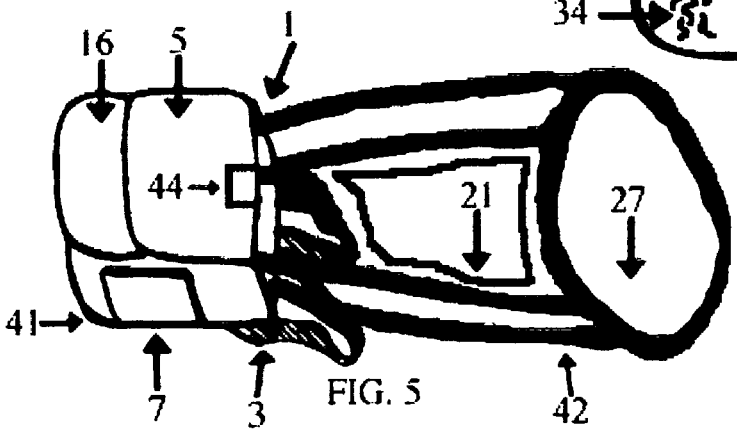

FIG. 5 shows a horizontal view of pack 41 and flexible funnel 42 wherein vent 27 is located about a lower portion where a user may be positioned so as to allow flexible funnel 42 to substantially surround the rear and sides of the user's body and wherein the front of the user may be unprotected. This may be a position the user would elect to use while hunting from the ground allowing the front of the user to remain open for an activity or other and wherein the said pack 41 and said flexible funnel 42 may be positioned on the downwind side allowing the user to face upwind allowing odor to enter and be adsorbed as it travels about flexible funnel 42 and may also travel through a portion or surface of said pack into main compartment 5 and secondary compartment 16 through top surface 1 where an odor filtering means 7 is located on an exterior surface of said pack 41. Further, odor-adsorption means 21 may be sized so as to cover a portion or substantially all or all of flexible funnel 42 and may appear in multiples about flexible funnel 42. Flexible funnel 42 may be securable to an item by any previously stated temporary means such as fastener 44, which may be selected from hook and loop, buckles, snaps, zippers, VELCRO® or other and may also appear in multiples about said flexible funnel 42 and/or pack 41 wherein said fastener 44 may also be used for detachably securing said flexible funnel 42 about said pack 41. Straps 3, which may be used to carry said product are also viewable.

While one embodiment of the present invention has been shown and described, it is obvious that many changes and modifications may be made thereunto without departing from the spirit and scope of the invention.

What is claimed is:

1. A product comprising: a.) a pack; wherein said pack has a main compartment and an attached or detachably securable secondary compartment; wherein said secondary compartment is located on an exterior surface of said main compartment, said main compartment having a first surface and said secondary compartment having a second surface, wherein said first surface is connected to said second surface along at least one edge; wherein said main compartment and said secondary compartment have an opened and closed position in which said first surface and said second surface oppose one another; wherein said first surface and said second surface may extend from said pack; and b.) a flexible funnel; wherein portions of said flexible funnel can be configured to cover a human or portion of a human; wherein the flexible funnel can be draped, wrapped or suspended about portions of a user, substantially all, or so as to enclose the majority of the user; wherein said flexible funnel consists of one or more layers detachably securable about one or more edges or portions of said first surface or said second surface or said main compartment or said secondary compartment or by combination about an internal or external portion of said pack; wherein said flexible funnel has a stowed position and a deployed position; wherein said flexible funnel is housed in said main compartment or said secondary compartment when said flexible funnel is in said stowed position; wherein said flexible funnel is deployed from said main compartment or said secondary compartment in said open position when said flexible funnel is in said deployed position; and c) an odor absorption means capable of being inserted or detachably securable about said flexible funnel or said pack; and d) an odor filtering means capable of being inserted or detachably securable about said flexible funnel or said pack; and e) a pocket affixed about said flexible funnel or said pack capable of receiving said odor adsorption means or said odor filtering means or another item and which may be located on the interior or exterior or between layers of said flexible funnel or said pack; and f) a fastening means or portion of a fastening means used to secure and attach portions of said product to one another or another item; and g) a vent; and h) an optional threaded pole which may be temporarily screwed or attached about a tree or object to support or suspend a portion of said product and items located about said product during use or storage of said product.

2. The product as defined in claim 1, wherein said pack is a backpack, fanny pack, duffle bag or storage pack.

3. The product as defined in claim 1, wherein said pack and said flexible funnel is made from one or more breathable or non-breathable materials; wherein said pack is made from a water repellant material or water proof material; wherein said flexible funnel is made from a water repellant material or water proof material; wherein said layers or portions of said funnel are constructed of materials; said material selected from the group consisting of: rubber, mesh, polyester, polypropylene, nylon, wool, cotton, multilayer laminates, or antimicrobial fabrics; wherein said flexible funnel is manufactured so as to be located about a user in entirety or by portion when deployed and which may be used independently of said pack so as to cover: the head region or chest region, back region, waist region, leg region, foot region, upper region or lower region or any combination thereof; wherein said flexible funnel can be of varying lengths and widths.

4. The product as defined in claim 1, wherein said pack or said flexible funnel is comprised of one or more layers, wherein when comprised of more than one layer, said layers being of similar or dissimilar material having an odor adsorption means or odor filtering means inserted or detachably securable about a portion or substantially all of said pack or said flexible funnel; wherein said flexible funnel is constructed of a flexible material which may be wrapped and folded so as to be easily stowed inside said pack or said main compartment or said secondary compartment of said pack when said flexible funnel is in said stowed position thereof; and wherein said flexible funnel is permanently attached or detachably securable to either or both said first surface or said secondary surface of said pack or said main compartment or said secondary compartment of said pack; and wherein said flexible funnel may extend from one or more sides or portions of said pack or said main compartment or said secondary compartment of said pack when said flexible funnel is in said deployed position thereof; wherein said flexible funnel can be detachably disconnected from said pack and wherein said flexible funnel containing said odor adsorption means; wherein portions of said product can be removed when not needed or for repair, replacement, exchange or storage; wherein said portions of said product may be inserted into another portion of said product, a re-sealable bag, container or non-permeable housing and housed therein or offered for sale or for use or storage.

5. A product as defined in claim 1, wherein said pack or said flexible funnel contains one or more vents allowing airflow to enter from the surrounding environment or exit from said pack or said flexible funnel into the environment; wherein said vent can be adjustably securable about a portion or in entirety; wherein said vents may be located about a surface, edge or other area allowing access, storage, use or removal of said odor adsorption means or said odor filtering means; wherein the user can enter, exit, or expose a potion or all of the entire user or an item from said vent at a desired moment of activity; wherein said one or more vents located about said flexible funnel or said pack or portions thereof may include a fastener or portion of a fastener selected from a group consisting of: zipper, buckles, D-rings, snaps, hook and loop fasteners, buttons, magnets, ties or suitable fastening means; wherein said product or said flexible funnel can be enclosed about one or more portions of said user.

6. The product as defined in claim 1, wherein said pack has at least one of a pattern and a coloration; wherein said pack has exposed surfaces; wherein said at least one of said pattern and said coloration of said pack is on said exposed surfaces of said pack for blending into the environment where said pack can be used; wherein said flexible funnel has at least one of a pattern and a coloration; wherein said flexible funnel has exposed surfaces; wherein said at least one of said pattern and said coloration of said flexible funnel is on said exposed surfaces of said flexible funnel for blending into the environment where said flexible funnel can be used.

7. The product as defined in claim 6, wherein said pattern is a camouflage pattern.

8. The product as defined in claim 1; further comprising one or more pockets; and wherein said one or more pockets may be positioned about an interior or exterior portion of said pack, said main compartment, said secondary compartment or said flexible funnel; wherein said odor adsorption means or said odor filtering means or items can be inserted or detachably securable about said one or more pocket and housed therein.

9. The product as defined in claim 1, wherein user may implement one or more odor adsorption means or odor filtering means having one or more odor adsorbing agents selected from the group consisting of: activated carbon or charcoal, baking soda, chlorophyll, activated alumina, potassium permanganate, zeolite, silver, chlorhexidine; wherein an odor adsorption means being comprised of one or more layers of breathable or non-breathable material having an odor absorbing agent located on the breathable or non-breathable materials; wherein said odor adsorption means or said odor filtering means can be substantially flat; and/or have one or more folded or sealed edges so as to form one or more cavities, chambers, channels, baffles, pleats or airflow restriction or adsorption features; wherein said odor adsorption means or said odor filtering means may be sized so as to cover a portion or substantially all of said flexible funnel or said pack; wherein said odor adsorption means or said odor filtering means can be inserted into a re-sealable bag, container, non-permeable housing, or a portion of said product and housed therein or offered for sale, use or storage.

10. The product as defined in claim 1, wherein said pack comprises at least one carrying strap; wherein said at least one carrying strap is disposed on said pack; and wherein said at least one carrying strap is for use in carrying said product comprising said pack and flexible funnel; wherein said pack has a fourth surface; and wherein said at least one carrying strap is disposed on said fourth surface of said pack; wherein said fourth surface of said pack is said first surface of said pack; and wherein said at least one carrying strap is a pair of shoulder straps; further comprising second means; wherein said second means includes fourth means for detachably fastening said second means and wherein said second means is for detachably securing said pack and/or said flexible funnel to a tree or other object when said product comprising said pack and/or said flexible funnel is used when hunting from the ground or from a tree stand and said main compartment or said secondary compartment is in said open position and said flexible funnel is in said deployed position thereof; wherein said fourth means is selected from the group consisting of: buckles, D-rings, hook and loop fasteners, snaps, buttons, magnets, and ties; wherein said second means includes at least one loop; wherein said at least one loop of said second means is at least one strap; wherein said at least one loop of said second means, when more than one loop, are spaced-apart from each other; further comprising first means; and wherein said first means may be used for detachably securing said pack and said flexible funnel to an object when said pack and said flexible funnel may be used in combination while hunting form the ground or in a tree stand; further comprising first means; and wherein said first means includes at least one loop; wherein said at least one loop of said first means is at least one strap; wherein said pack has a third surface; and wherein said first means is disposed on said third surface of said pack; wherein said pack has a top surface; and wherein said third surface of said pack is said top surface of said pack; wherein said pack has an interior; and defined by said main compartment; wherein said interior of said pack is accessible from said top surface of said pack; wherein said top surface of said pack has a zipper or suitable fastener; and wherein said interior of said pack is accessible from said zipper located about said top surface of said pack; wherein said pack or said main compartment or said secondary compartment of said pack may house said odor adsorption means or odor filtering means during use or storage.

11. The product as defined in claim 1, wherein a variety of said fastening means may be located singularly or in plurality about portions of said product and may be used to detachably secure a portion of said product to one or more similar or different portions of said product; wherein an optional threaded hanging rod or similar can be used with said fastening means wherein said threaded rod may be screwed into a tree and said fastening means positioned about said threaded hanging rod so as to support or suspend a portion or said product allowing the user to manipulate one or more portions so as to expose, cover or collapse a portion or substantially all of said flexible funnel and/or said product at a desired moment of activity whether for use or storage; said manipulating selected from the group consisting of: slide, re-tract, or roll the flexible funnel about; and wherein said fastening means may be selected from the group consisting of: loops, zippers, buckles, D-rings, snaps, buttons, ties, magnets, hook and loop fasteners or suitable fastener.

12. A product as defined in claim 1, wherein said flexible funnel is deployed and adjustably positioned about a portion of the user, pack or an object so as to allow said flexible funnel to substantially or by portion surround the user; wherein said flexible funnel may be constructed or positioned so as to lay substantially flat; and wherein said flexible funnel may be constructed or positioned or so as to have an inner void or cavity about which the user may be located; wherein said flexible funnel may be draped, wrapped or suspended about the user; and wherein said portions may be fastened or manufactured so as to enclose one or more portions of the user.

13. A product as defined in claim 1, wherein said pack and said flexible funnel contain one or more vents positioned horizontally, vertically, diagonally or erratically which may be used to adjustably regulate airflow; wherein said vents are located about a portion or portions upwind side of the user; wherein the downwind portion of the user can be substantially surrounded in portion or entirety; wherein said users odor or scent stream can be moved, carried, blown or by other means so as to encounter said odor adsorbing means or said odor filtering means located about said flexible funnel or said pack or by combination.

14. A product as defined in claim 1, wherein one or more similar or dissimilar portions of said product may be added, deployed or used by one or more users; selected from the group consisting of: a father and son, hunter and cameraman using two flexible funnels of similar or dissimilar weather properties deployed from said pack containing a plurality of said odor filtering means used by two users, or two flexible funnels of similar or dissimilar weather properties deployed from said pack containing a plurality of said odor adsorption means and used by one user.

15. A product as defined in claim 1, comprising said pack and said flexible funnel used in combination; wherein the user may position said pack and said flexible funnel about a portion or substantially all of said user; wherein said flexible funnel can be used separately from said pack; wherein said flexible funnel may be positioned or located about one or more portions of said user; wherein said user may perform a function selected from the group consisting of: walk, run, skip, crawl, slide, hop, climb, sit, stand, or engage in hunting, riding on an animal, vehicle or all terrain vehicle for the purpose of hunting, scouting, stalking or observing.

16. A product as defined in claim 1, wherein said backpack, said flexible funnel, said pocket, said odor adsorption means and said odor filtering means or said portions of said product include an elastic, rubber, vinyl, foam, plastic, flexible wire or another flexible means located about one or more portions or edges which may be internally or externally located about said portions of said product.

17. A product as defined in claim 1, wherein said pack, said flexible funnel, said pocket, said odor adsorption means, said odor filtering means or said portions of said product include a cover which is securable by any fastening means so as to enclose by portion or in entirety said portions or said product whether for use or storage.

18. A product as defined in claim 1, wherein said flexible funnel may include a removable portion and is adapted so as to receive said removable portion; wherein said removable portion is detachably securable about said flexible funnel; wherein said removable portion consists of one or more layers, wherein said removable portion having said odor adsorption means, said odor filtering means, said fastening means or said pocket or portions of said product; wherein said removable portion having at least one of a pattern and a coloration; wherein said removable portion has at least one exposed surface; wherein said at least one said pattern and said coloration of said removable portion is on said exposed surface of said removable portion for blending into the environment where said removable portion can be used.

19. The product as defined in claim 1, wherein said materials selected for constructing said pack, said flexible funnel, said pocket, said removable portion, and said cover consist of a camouflage pattern.

20. A product as defined in claim 1, wherein materials selected for constructing said pack, said flexible funnel, said pocket, removable portion or said cover consist of a three dimensional camouflage pattern; wherein said three dimensional pattern and coloration is selected from a pattern and coloration similar to: a leaf design, grass design, jute, weeds, limbs, corn stalk, trees or foliage and be used for blending into the environment where said product can be used.

* * * * *